US008831757B2

(12) United States Patent
Kuroiwa et al.

(10) Patent No.: US 8,831,757 B2
(45) Date of Patent: Sep. 9, 2014

(54) EQUIPMENT CONTROL DEVICE

(75) Inventors: Takeru Kuroiwa, Chiyoda-ku (JP); Masanori Nakata, Chiyoda-ku (JP); Tomoaki Gyota, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 419 days.

(21) Appl. No.: 13/393,845

(22) PCT Filed: Apr. 6, 2010

(86) PCT No.: PCT/JP2010/056253

§ 371 (c)(1),
(2), (4) Date: Mar. 2, 2012

(87) PCT Pub. No.: WO2011/027587

PCT Pub. Date: Mar. 10, 2011

(65) Prior Publication Data

US 2012/0158159 A1 Jun. 21, 2012

(30) Foreign Application Priority Data

Sep. 3, 2009 (JP) ..... 2009-204059

(51) Int. Cl.
*G06F 19/00* (2011.01)
*F24F 11/00* (2006.01)

(52) U.S. Cl.
CPC ..... *F24F 11/006* (2013.01); *F24F 2011/0063* (2013.01)
USPC ..... 700/83; 236/51; 709/223

(58) Field of Classification Search
USPC ..... 700/9, 17, 83, 276
See application file for complete search history.

(56) References Cited

U.S. PATENT DOCUMENTS 6,061,603 A * 5/2000 Papadopoulos et al. ..... 700/83
7,003,558 B2 * 2/2006 Agrusa et al. ..... 709/223

(Continued)

FOREIGN PATENT DOCUMENTS

JP 2000-320880 A 11/2000
JP 2003-303112 A 10/2003

(Continued)

OTHER PUBLICATIONS

International Search Report (PCT/ISA/210) issued on Jun. 22, 2010, by Japanese Patent Office as the International Searching Authority for International Application No. PCT/JP2010/056253.

(Continued)

*Primary Examiner* — Kidest Bahta
(74) *Attorney, Agent, or Firm* — Buchanan Ingersoll & Rooney PC

(57) ABSTRACT

An air-conditioning information storer (13) stores data received by a communicator (11) from air conditioners (2) and sensors (3) as air-conditioning information. A controller (10) executes control programs including at least a PLC program, determines control details for each air conditioner (2) in accordance with the air-conditioning information stored in the air-conditioning information storer (13), and stores the determined control details as air-conditioning information in the air-conditioning information storer (13). Furthermore, the controller (10) transmits control data based upon the determined control details to the corresponding air conditioner (2) via the communicator (11). Moreover, the controller (10) updates the PLC program on the basis of an operation performed by the user. Air-conditioning information is stored at a predetermined address within the air-conditioning information storer (13) in accordance with the type and content of the corresponding equipment.

8 Claims, 11 Drawing Sheets

(56) References Cited

U.S. PATENT DOCUMENTS

| | | | | |
|---|---|---|---|---|
| 7,352,282 | B2 * | 4/2008 | Yanagida et al. | 340/538 |
| 7,788,189 | B2 * | 8/2010 | Budike, Jr. | 705/400 |
| 2008/0053122 | A1 | 3/2008 | Yokoi | |

FOREIGN PATENT DOCUMENTS

| | | | |
|---|---|---|---|
| JP | 2003-307335 | A | 10/2003 |
| JP | 2004-360925 | A | 12/2004 |
| JP | 2005-44369 | A | 2/2005 |
| JP | 2005-295130 | A | 10/2005 |
| JP | 2007-327656 | A | 12/2007 |
| JP | 2008-32288 | A | 2/2008 |
| JP | 2008-57893 | A | 3/2008 |

OTHER PUBLICATIONS

Written Opinion (PCT/ISA/237) issued on Jun. 22, 2010, by Japanese Patent Office as the International Searching Authority for International Application No. PCT/JP2010/056253.

First Office Action issued on Dec. 27, 2013, by the Chinese Patent Office in corresponding Chinese Patent Application No. 201080039007.4, and an English Translation of the Office Action (10 pages).

* cited by examiner

FIG.3

| OPERATION CODE | DESIGNATED PORT |
|---|---|
| SET | INPUT 1 |
| AND | INPUT 2 |
| OUT | OUTPUT 1 |
| SET | INPUT 3 |
| OR | INPUT 5 |
| OR | INPUT 6 |
| OUT | OUTPUT 2 |
| SETI | INPUT 4 |
| OUT | OUTPUT 3 |
| : | : |

FIG.4

| No. | PARAMETER 1 | PARAMETER 2 | OPERATION CODE | PORT No. | OUTPUT VALUE |
|---|---|---|---|---|---|
| 1 | ADDRESS CORRESPONDING TO TEMPERATURE | ADDRESS CORRESPONDING TO SET TEMPERATURE OF AIR CONDITIONER 2A | < | 1 | OFF |
| 2 | ADDRESS CORRESPONDING TO HUMIDITY | 70 | > | 2 | ON |
| : | : | : | : | : | : |

FIG.5

| No. | PARAMETER 1 (PORT No.) | PARAMETER 2 (PORT No.) | OPERATION CODE | OUTPUT DESTINATION | OUTPUT VALUE |
|---|---|---|---|---|---|
| 1 | 1 | 2 | = | ADDRESS CORRESPONDING TO RUN/STOP OF AIR CONDITIONER 2A | OFF |
| 2 | 2 | 3 | = | ADDRESS CORRESPONDING TO RUN/STOP OF AIR CONDITIONER 2B | ON |
| : | : | : | : | : | : |

FIG.10

| No. | PARAMETER 1 | PARAMETER 2 | OPERATION CODE | PORT No. | OUTPUT VALUE |
|---|---|---|---|---|---|
| 1 | X001 | A001 | < | 1 | OFF |
| 2 | X002 | 70 | > | 2 | ON |
| : | : | : | : | : | : |

FIG.11

| AIR CONDITIONING INFORMATION ID | CONTENT |
|---|---|
| X001 | AREA TEMPERATURE |
| X002 | AREA HUMIDITY |
| : | : |
| A001 | SET TEMPERATURE OF AIR CONDITIONER 2A |
| : | : |
| A010 | RUN/STOP OF AIR CONDITIONER 2A |
| : | : |
| B001 | SET TEMPERATURE OF AIR CONDITIONER 2B |
| : | : |
| B010 | RUN/STOP OF AIR CONDITIONER 2B |
| : | : |

FIG.12

| ADDRESS CONVERSION INFORMATION | | |
|---|---|---|
| AIR-CONDITIONING INFORMATION ID | ADDRESS | CONTENT |

FIG.13

| No. | PARAMETER 1 (PORT No.) | PARAMETER 2 (PORT No.) | OPERATION CODE | OUTPUT DESTINATION | OUTPUT VALUE |
|---|---|---|---|---|---|
| 1 | 1 | 2 | = | A010 | OFF |
| 2 | 2 | 3 | = | B010 | ON |
| : | : | : | : | : | : |

EQUIPMENT CONTROL DEVICE

TECHNICAL FIELD

The present invention relates to an equipment control device controlling equipment such as air conditioners according to area conditions.

BACKGROUND ART

Systems in which an air-conditioning control device controls multiple air conditioners connected via a network (air-conditioning systems) are disclosed, for example, in Patent Documents 1 to 4.

RELATED REFERENCES

Patent Documents

Patent Document 1: Unexamined Japanese Patent Application KOKAI Publication No. 2005-44369;

Patent Document 2: Unexamined Japanese Patent Application KOKAI Publication No. 2000-320880;

Patent Document 3: Unexamined Japanese Patent Application KOKAI Publication No. 2003-303112; and Patent Document 4: Unexamined Japanese Patent Application KOKAI Publication No. 2008-32288.

DETAILED DESCRIPTION OF THE INVENTION

Problems to be Solved by the Invention

In the above kind of air-conditioning systems, it is desirable that the air-conditioning control device is capable of controlling the air conditioners according to the condition of the air-conditioned area in a building from the viewpoint of improvement in terms of amenity and energy saving.

However, in conventional air-conditioning systems, the air-conditioning control device is placed at a specific location (such as an equipment management room) and integrated into a system monitoring device collectively controlling all air conditioners and other equipment. Therefore, it is difficult in a conventional air-conditioning system to control air-conditioning according to the condition of each air-conditioned area in a building.

The present invention was invented to solve the above problem and an exemplary object of the present invention is to provide an equipment control device capable of controlling equipment placed in individual areas in accordance with the condition of each area.

Means for Solving the Invention

In order to achieve the above objective, the equipment control device according to the present invention comprises:

a communication means for transmitting and receiving data with one or multiple equipments placed in a given area via a given network;

an equipment information storage means storing data received by the communication means from the equipment as equipment information;

a PLC program storage means storing a PLC (Programmable Logic Controller) program;

a control details determination means executing control programs including at least the PLC program, determining control details of the each equipment based on the equipment information stored in the equipment information storage means, and storing the determined control details as the equipment information in the equipment information storage means;

a control necessity determination means determining whether it is necessary to conduct control over a corresponding equipment based on the control details determined by the control details determination means;

a control data transmission means transmitting control data based on the control details to the corresponding equipment via the communication means when the control necessity determination means determines that it is necessary to conduct the control;

an operation means receiving operations from a user and displaying processing results based on the operation; and a PLC program update means updating the PLC program based on operations from the user, wherein the equipment information storage means stores the equipment information at an address predetermined based on the corresponding equipment and the content thereof.

Effects of the Invention

The present invention is capable of controlling equipment placed in individual areas in accordance with the actual condition of each area.

BRIEF DESCRIPTION OF DRAWINGS

[FIG. 3] An illustration for explaining a PLC program;

[FIG. 4] An illustration for explaining PLC input conditional expression;

[FIG. 5] An illustration for explaining PLC output conditional expression;

[FIG. 10] An illustration for explaining a PLC input conditional expression edit screen;

[FIG. 11] An illustration showing an exemplary list of air-conditioning information IDs;

[FIG. 12] An illustration showing another structure of the address conversion information;

[FIG. 13] An illustration for explaining a PLC output conditional expression edit screen;

BEST MODE FOR CARRYING OUT THE INVENTION

The equipment control device according to embodiments of the present invention will be described in detail hereafter with reference to the drawings.

(Embodiment 1)

An equipment control device 1 according to Embodiment 1 is connected to multiple pieces of equipment (multiple air conditioners 2) placed in a given area within a building and multiple sensors 3 detecting the temperature and humidity of the area in a communicable manner via a network N conforming with a given LAN (local area network) standard. The equipment control device 1 is installed in or near the area.

The air conditioners 2 and sensors 3 are connected to a system monitoring device (placed at a specific location in the building) via a given network different from the network N together with other equipment installed in the building (for example, an office building). The system monitoring device collectively controls the air conditioners 2 and sensors 3.

Figure 1:
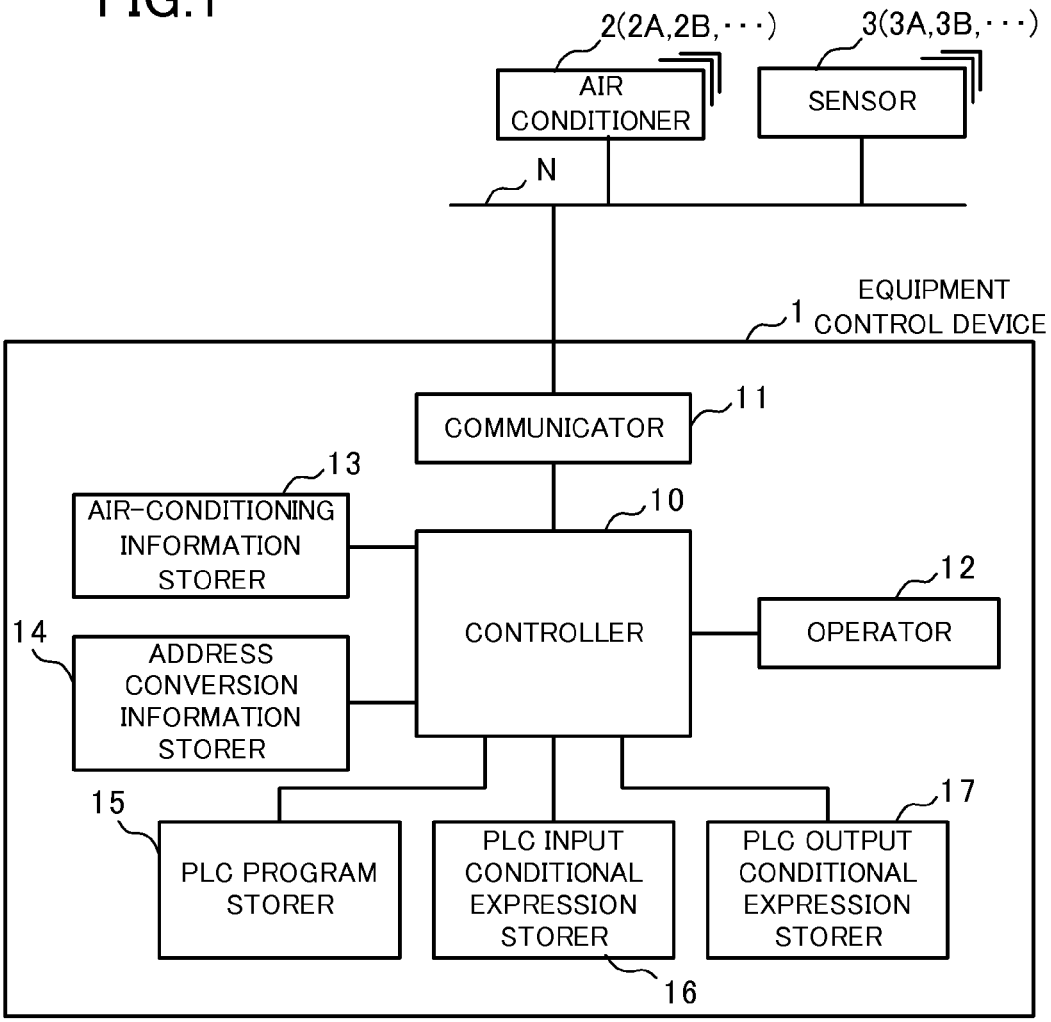
[FIG. 1] A block diagram showing the configuration of an equipment control device according to Embodiment 1 of the present invention.

As shown in FIG. 1, the equipment control device 1 comprises a controller 10, a communicator 11, an operator 12, air-conditioning information storer 13, address conversion information storer 14, a PLC program storer 15, PLC input conditional expression storer 16, and PLC output conditional expression storer 17.

The controller 10 is composed of a CPU (central processing unit) or MPU (micro-processing unit). The controller 10 controls the communicator 11, operator 12, air-conditioning information storer 13, address conversion information storer 14, PLC program storer 15, PLC input conditional expression storer 16, and PLC output conditional expression storer 17, and accordingly exchanges data with them. The functions of the control details determiner, control necessity determiner, PLC program updater, PLC input conditional expression updater, and PLC output conditional expression updater of the present disclosure are realized by the controller 10.

The communicator 11 is composed of communication hardware such as a network card. The communicator 11 performs data communication with the air conditioners 2 and sensors 3 via the network N under the control of the controller 10. Here, the communicator 11 can have an additional function of transmitting and receiving data with the above system monitoring device via a network different from the network N.

The operator 12 is composed of an input device such as a keyboard, keypad, touch pad, and mouse, and a display device such as a CRT and liquid crystal monitor. The operator 12 receives operation input from the user such as an operator and sends received signals (operation signals) to the controller 10. Furthermore, the operator 12 displays the results (character and image data) of processing of the controller 10 based on the received operation.

Air-conditioning information storer 13 (the equipment information storer) is composed of readable/writable nonvolatile semiconductor memory or hard disc drive. The air-conditioning information storer 13 stores air-conditioning information (equipment information). The air-conditioning information is information indicating the operation state of the air conditioners 2 (run/stop, set temperature, wind speed, wind direction, etc.) and the detection results of the sensors 3 (temperature, humidity, etc.). The air-conditioning information storer 13 pre-stores the operation states of the air conditioners 2 and the detection results of the sensors 3 in given memory regions assigned to the air conditioners 2 and sensors 3, respectively. The memory regions of the air-conditioning information storer 13 are defined on the basis of categories of operation states of the air conditioners 2 (run/stop, set temperature, wind speed, wind direction, etc.).

Figure 2:
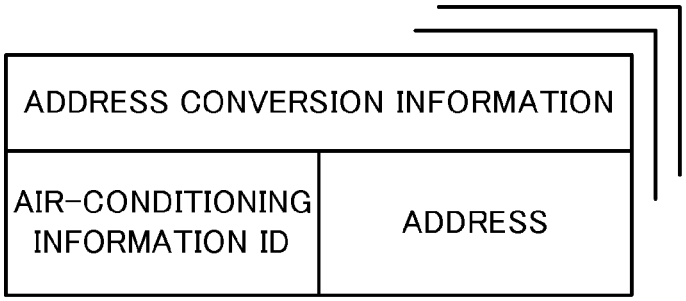
[FIG. 2] An illustration showing the structure of address conversion information.

Address conversion information storer 14 is composed of readable/writable nonvolatile semiconductor memory or a hard disc drive. The address conversion information storer 14 stores multiple pieces of address conversion information. The address conversion information is information associating an address in the air-conditioning information storer 13 with an air-conditioning information ID as shown in FIG. 2. The air-conditioning information ID is identification information pre-assigned by the system administrator to uniquely identify addresses at which air-conditioning information is stored.

PLC program storer 15 is composed of a readable/writable nonvolatile semiconductor memory or hard disc drive. The PLC program storer 15 stores a program written in a programming language for PLCs (Programmable Logic Controllers) conducting process control or sequence control in factory automation (FA) (simply referred to as a PLC program hereafter). A PLC program consists of, as shown in FIG. 3, multiple sets of an operation code and a designated port.

For executing a PLC program, the controller 10 executes logical operations indicated by the above sets in a given sequence (for example, the arrowed direction in FIG. 3). The operation codes given in FIG. 3 by way of example have the following meaning:

- SET: set the value (ON/OFF) of the designated port in the work memory (such as an RAM (random access memory) provided to the controller 10);
- SETI: set the inverted value of the value of the designated port in the work memory;
- AND: set the value obtained by logical product (AND) of the value in the work memory and the value of the designated port in the work memory;
- OR: set the value obtained by logical addition (OR) of the value in the work memory and the value of the designated port in the work memory; and
- OUT: output the value in the work memory to the designated port.

Returning FIG. 1, the PLC input conditional expression storer 16 is composed of a readable/writable nonvolatile semiconductor memory or hard disc drive. PLC input conditional expression storer 16 stores multiple PLC input conditional expression. PLC input conditional expression are used in a PLC input program executed by the controller 10. The PLC input program is stored in a not-shown ROM (read only memory) provided to the controller 10 or in a not-shown hard disc drive provided to the equipment control device 1. As shown in FIG. 4, a PLC input conditional expression is composed of multiple parameters (here, two parameters), an operation code, an output destination port number, and an output value (ON/OFF).

The parameters include the addresses at which specified air-conditioning information is stored (namely, the addresses in the air-conditioning information storer 13) and numerical values. The output destination port number matches the input port number in the PLC program shown in FIG. 3.

For example, the PLC input conditional expression No. 1 in FIG. 4 means that if the temperature (namely, a detected value of a temperature sensor (for example, a sensor 3A)) is lower than the set temperature of an air conditioner 2A, the port No. 1 (the input port 1 in the PLC program) is set to OFF. Furthermore, the PLC input conditional expression No. 2 means that if the humidity (namely, the detected value of a humidity sensor (for example, a sensor 3B)) is higher than 70(%), the port No. 2 (the input port 2 in the PLC program) is set to ON.

PLC output conditional expression storer 17 is composed of readable/writable nonvolatile semiconductor memory or hard disc drive. The PLC output conditional expression storer 17 stores multiple PLC output conditional expression. PLC output conditional expression are used in a PLC output program executed by the controller 10. The PLC output program is stored in a not-shown ROM provided to the controller 10 or in a not-shown hard disc drive provided to the equipment control device 1. As shown in FIG. 5, a PLC output conditional expression is composed of multiple parameters (here, two parameters), an operation code, an output destination, and an output value (ON/OFF, numerical values, etc.).

The parameters include the output port numbers in the PLC program. The output destination includes an address at which the output value of the PLC output conditional expression is to be stored (an address in the air-conditioning information storer 13).

For example, the PLC output conditional expression No. 1 in FIG. 5 means that if the value (ON or OFF) of the output 1 and the value (ON or OFF) of the output 2 are equal, OFF (which means "stop") is set at the address corresponding to the run/stop of the air conditioner 2A in the air-conditioning information storer 13. Furthermore, the PLC output conditional expression No. 2 means that if the value of the output 2 and the value of the output 3 are equal, ON (which means "run") is set at the address corresponding to the run/stop of the air conditioner 2B in the air-conditioning information storer 13.

Here, the air-conditioning information storer 13, address conversion information storer 14, PLC program storer 15, PLC input conditional expression storer 16, and PLC output conditional expression storer 17 can be composed of the same semiconductor memory or the same hard disc drive.

The equipment control device 1 having the above configuration generally has two operation modes: a normal operation mode and a control programs update mode. The equipment control device 1 executes a normal operation procedure in the normal operation mode and executes a control programs update procedure in the control programs update mode.

Figure 6:
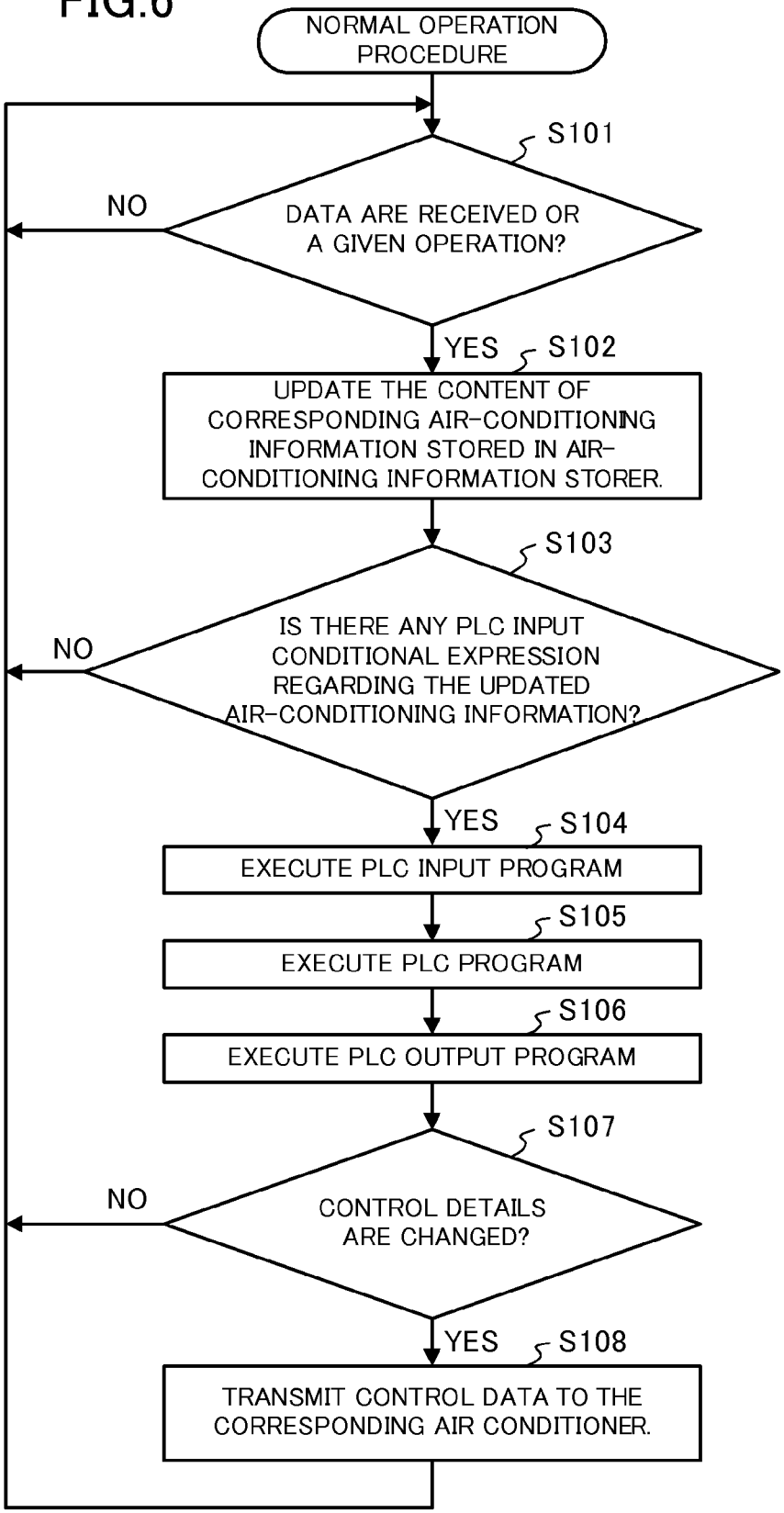
[FIG. 6] A flowchart showing the normal operation procedure.

FIG. 6 is a flowchart showing the normal operation procedure. The normal operation procedure starts when the equipment control device 1 is powered on. The following procedure is repeated until the user switches the operation mode to the control program update mode.

When the communicator 11 receives data sent from an air conditioner 2 or sensor 3 or when the operator 12 receives from the user an operation regarding control of an air conditioner 2 (Step S101; YES), the controller 10 analyses the content of the received data or the content of the user operation, and updates the content of the corresponding air-conditioning information stored in the air-conditioning information storer 13 (Step S102).

The controller 10 determines whether the address at which the updated air-conditioning information is stored is a parameter of any PLC input conditional expression, namely whether there is any PLC input conditional expression regarding the updated air-conditioning information (Step S103). If there is no PLC input conditional expression (Step S103; NO), the controller 10 waits for next data or a user operation relating to the air conditioners 2 (Step S101).

On the other hand, if there is a PLC input conditional expression (Step S103; YES), the controller 10 reads the PLC input program stored in a ROM or the like and executes it (Step S104). As the PLC input program is executed, operations according to the descriptions in all PLC input conditional expression are executed and the ports having the specified numbers are set to ON or OFF according to the results.

Then, the controller 10 reads the PLC program stored in the PLC program storer 15 and executes it (Step S105). Subsequently, the controller 10 reads the PLC output program stored in an ROM or the like and executes it (Step S106). As the PLC output program is executed, all PLC output conditional expression are read from the output conditional expression storer 17, operations according to the descriptions in the PLC output conditional expression are executed, and the specified values are stored at the specified addresses in the air-conditioning information storer 13 according to the operation results.

After the PLC output program is executed, the controller 10 determines whether there is any air conditioner 2 having the control details changed (Step S107). If there is no change in the control details (Step S107; NO), the controller 10 waits for the next data or a user operation relating to the air conditioners 2 (Step S101).

If there is an air conditioner 2 having the control details changed (Step S107; YES), the controller 10 creates control data corresponding to the changed control details and sends the control data to the corresponding air conditioner 2 via the communicator 11 (Step S108). For example, in the case where the air conditioner 2B is first at rest (namely, the value stored at an address corresponding to the run/stop is OFF) and, after the above PLC output program is executed, the value stored at the address is changed to ON, the controller 10 sends out control data to shift the air conditioner 2B to the running state.

Figure 7:
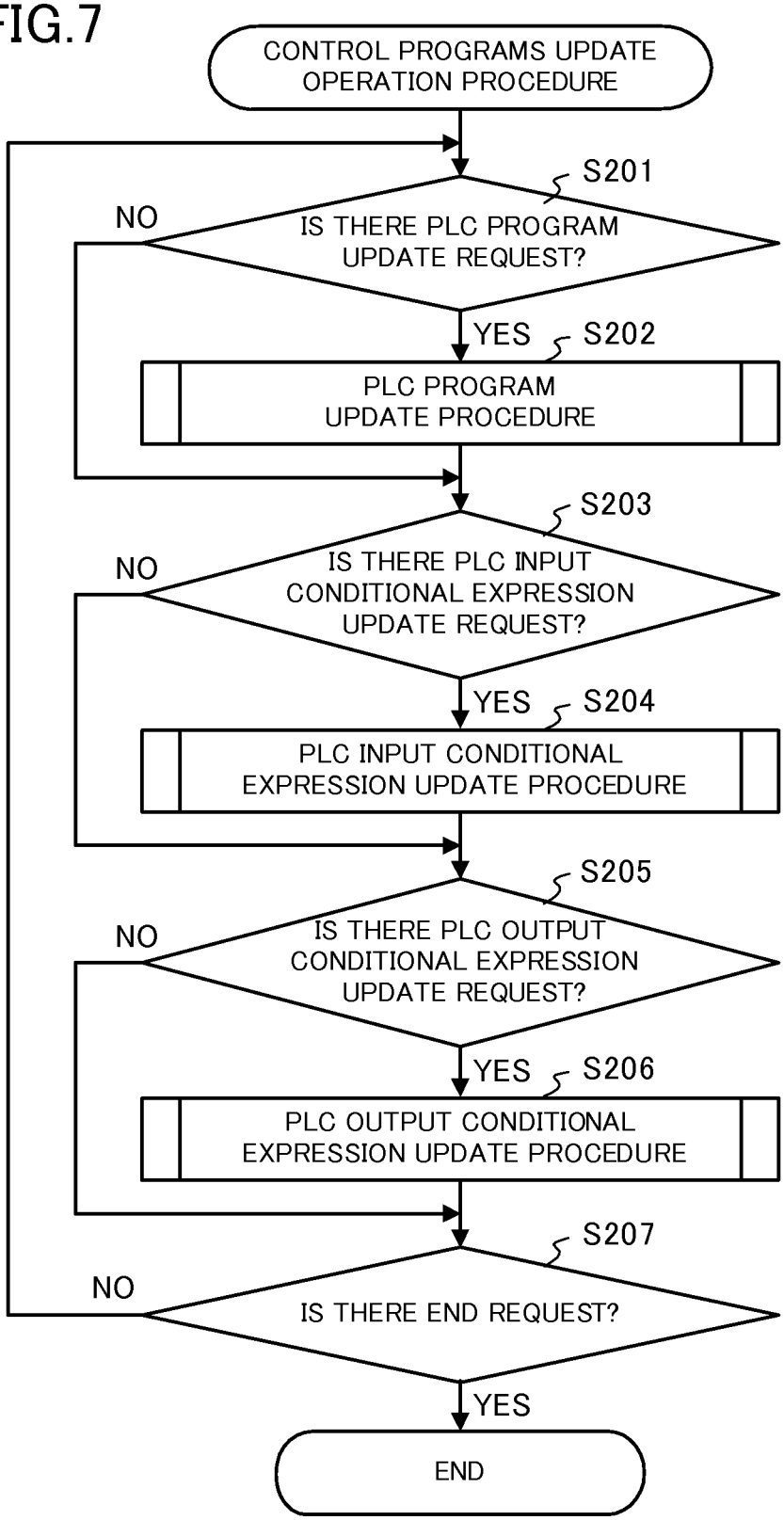
[FIG. 7] A flowchart showing the control program update procedure.

The control programs update procedure in the control programs update mode will be described hereafter. FIG. 7 is a flowchart showing the control programs update procedure. The control program update procedure starts when the user conducts a given operation (a switching operation to the control programs update mode) via the operator 12, and the following procedure is repeated until the user conducts an operation to end the procedure (the end request operation).

If the user conducts a PLC program update request operation via the operator 12 (Step S201; YES), the controller 10 executes the PLC program update procedure (Step S202).

Figure 8:
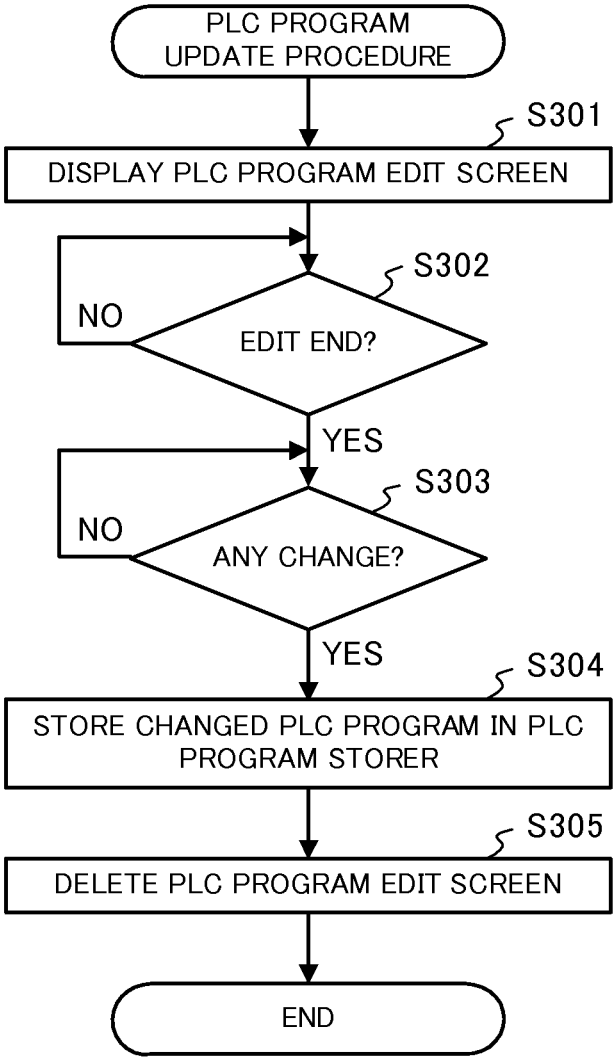
[FIG. 8] A flowchart showing the PLC program update procedure.

FIG. 8 is a flowchart showing the PLC program update procedure. First, the controller 10 reads the PLC program stored in the PLC program storer 15. The controller 10 creates a PLC program edit screen based on the content of the PLC program and displays it on the liquid crystal monitor or the like of the operator 12 (Step S301). The source codes of the current PCL program (see FIG. 3) is displayed on the PLC program edit screen in an editable manner.

The user edits the content of an intended part (operation code or designated port) of the PLC program source codes via the PLC program edit screen. Then, as the user conducts an edit end operation (Step S302; YES), the controller 10 checks whether there is any change in the content of the source codes. If there is any change (Step S303; YES), the controller 10 reflects the content edited by the user in the PLC program and stores the reflected PLC program in the program storer 15 (Step S304).

Then, the controller 10 deletes the PLC program edit screen (Step S305) and ends the PLC program update procedure. If the user conducts an edit end operation (Step S302; YES) and there is no change in the source codes (Step S303; NO), the controller 10 immediately deletes the PLC program edit screen (Step S305) and ends the PLC program update procedure.

Here, it is possible to create a PLC program on another personal computer or on the system monitoring device, and enter it into the controller 10 via a serial interface or USB (universal serial bus) interface or the Ethernet (registered trademark) interface so that the controller 10 can store it in the PLC program storer 15.

Returning to FIG. 7, if the user conducts a PLC input conditional expression update request operation via the operator 12 (Step S203; YES), the controller 10 executes the PLC input conditional expression update procedure (Step S204).

Figure 9:
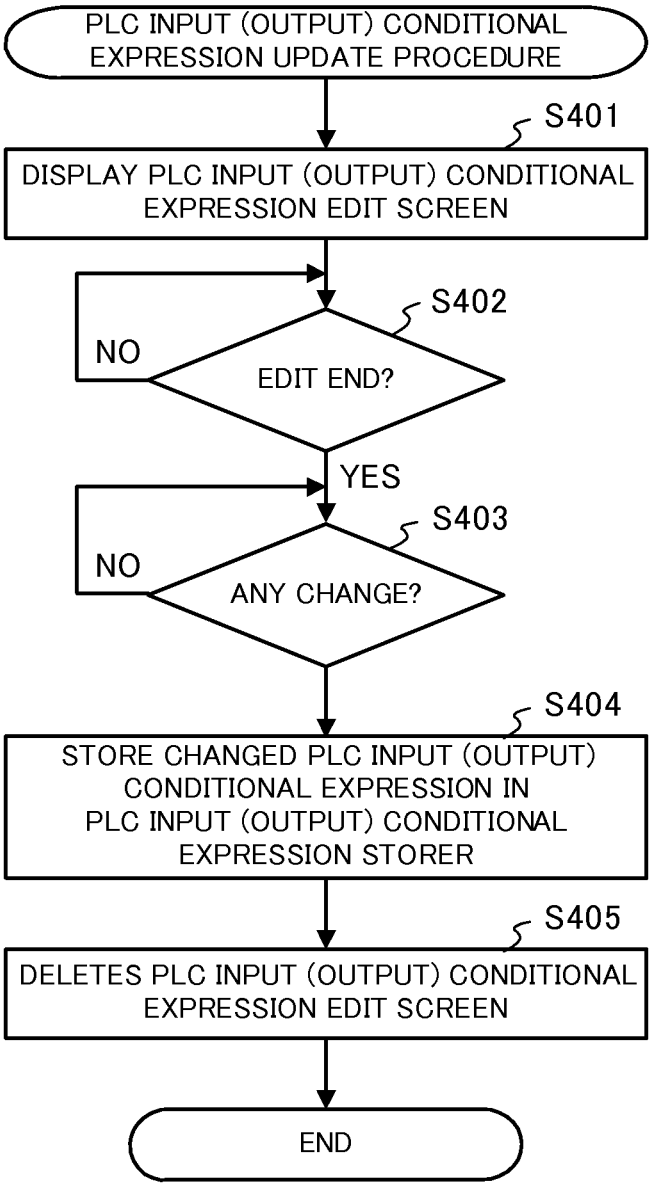
[FIG. 9] A flowchart showing the PLC input (output) conditional expression update procedure.

FIG. 9 is a flowchart showing the PLC input conditional expression update procedure. First, the controller 10 reads all PLC input conditional expression stored in the PLC input conditional expression storer 16 and all address conversion information stored in the address conversion information storer 14. The controller 10 creates a PLC input conditional expression edit screen based on the read PLC input conditional expression and address conversion information and displays it on the liquid crystal monitor or the like of the operator 12 (Step S401). For example, as shown in FIG. 10, a list of PLC input conditional expression is displayed on the PLC input conditional expression edit careen, in which fields (parameter 1, parameter 2, operation code, output destination port number, and output value) are displayed in an editable manner.

As shown in FIG. 10, on this PLC input conditional expression edit screen, the fields "parameter 1" and "parameter 2" of PLC input conditional expression display air-conditioning information IDs corresponding to addresses in the air-conditioning information storer 13 instead of the addresses. This is because:

(1) Direct input of an address is very troublesome for the user and easily causes an input error; and (2) If free address setting is allowed, an improper address may be set, which may lead to control not intended by the system administrator or a risk of the equipment control device 1 becoming unable to control the air conditioners 2.

For the above reason, the address in air-conditioning information storer 13 is hidden and, instead, the air-conditioning information ID is displayed in displaying the PLC input conditional expression on the PLC input conditional expression edit screen.

The user edits the content in an intended field of an intended PLC input conditional expression on the PLC input conditional expression edit screen. Here, the controller 10 may display a list of air-conditioning information IDs (an air-conditioning information ID list) as shown in FIG. 11 on the PLC input conditional expression edit screen. With such an air-conditioning information ID list being displayed, the user can easily recognize the meaning of the air-conditioning information indicated by the air-conditioning information ID and edit the parameter 1 or 2 in a PLC input conditional expression.

In order to display such an air-conditioning information ID list, for example, the address conversion information stored in the address conversion information storer 14 can be constituted as shown in FIG. 12.

Furthermore, the user can not only edit existing PLC input conditional expression but also add new PLC input conditional expression. In such a case, for example, if the user conducts a PLC input conditional expression addition request operation after the PLC input conditional expression edit screen is displayed, the controller 10 adds a new record for a PLC input conditional expression having all blank fields at the end of the list of PLC input conditional expression displayed on the PLC input conditional expression update screen.

Then, when the user eventually conducts an edit end operation (Step S402; YES), the controller 10 checks whether there is any PLC input conditional expression edited (changed) on the PLC input conditional expression edit screen (Step S403). If there is any change (Step S403; YES), the controller 10 stores the changed PLC input conditional expression in the PLC input conditional expression storer 16 (Step S404). In doing so, the controller 10 converts the air-conditioning information ID in the field "parameter 1" or "parameter 2" of the PLC input conditional expression on the PLC input conditional expression edit screen to the corresponding address by making reference to the address conversion information (except that a numerical value is directly entered).

Then, the controller 10 deletes the PLC input conditional expression edit screen (Step S405) and ends the PLC input conditional expression update procedure.

If the user conducts an edit end operation (Step 402; YES) and there is no change in the PLC input conditional expression (Step S403; NO), the controller 10 immediately deletes the PLC input conditional expression edit screen (Step S405) and ends the PLC input conditional expression update procedure.

Here, it is possible to create a PLC input conditional expression on another personal computer or on the system monitoring device and enter it into the controller 10 via a serial interface or USB interface or the Ethernet (registered trademark) interface so that the controller 10 can store it in the PLC input conditional expression storer 16.

Returning to FIG. 7, if the user conducts a PLC output conditional expression update request operation via the operator 12 (Step S205; YES), the controller 10 executes the PLC output conditional expression update procedure (Step S206).

The PLC output conditional expression update procedure is nearly the same as the above described PLC input conditional expression update procedure. The PLC output conditional expression update procedure is described hereafter with reference to the flowchart in FIG. 9.

First, the controller 10 reads all PLC output conditional expression stored in the PLC output conditional expression storer 17 and all address conversion information stored in the address conversion information storer 14. The controller 10 creates a PLC output conditional expression edit screen based on the read PLC output conditional expression and address conversion information and displays it on the liquid crystal monitor or the like of the operator 12 (Step S401).

On the PLC output conditional expression edit careen, for example, as shown in FIG. 13, a list of PLC output conditional expression is displayed, in which fields (parameter 1, parameter 2, operation code, output destination, and output value) are displayed in an editable manner.

As shown in FIG. 13, on this PLC output conditional expression edit screen, the field "output destination" of PLC output conditional expression displays an air-conditioning information ID corresponding to an address in the air-conditioning information storer 13 instead of the address. The reason is the same as described above for the PLC input conditional expression update procedure.

The user edits the content in an intended field of an intended PLC output conditional expression on the PLC output conditional expression edit screen. Here, as in the above described PLC input conditional expression update procedure, the controller 10 may display a list of air-conditioning information IDs as shown in FIG. 11 on the PLC output conditional expression edit screen.

Then, when the user eventually conducts an edit end operation (Step S402; YES), the controller 10 checks whether there is any PLC output conditional expression edited (changed) on the PLC output conditional expression edit screen (Step S403). If there is any change (Step S403; YES), the controller 10 stores the changed PLC output conditional expression in the PLC output conditional expression storer 17 (Step S404). In doing so, the controller 10 converts the air-conditioning information ID in the field "output destination" of the PLC output conditional expression on the PLC output conditional expression edit screen to the corresponding address by making reference to the address conversion information.

Then, the controller 10 deletes the PLC output conditional expression edit screen (Step S405) and ends the PLC output conditional expression update procedure.

If the user conducts an edit end operation (Step 402; YES) and there is no change in the PLC output conditional expression (Step S403; NO), the controller 10 immediately deletes the PLC output conditional expression edit screen (Step S405) and ends the PLC output conditional expression update procedure.

Here, it is possible to create a PLC output conditional expression on another personal computer or on the system monitoring device and enter it into the controller 10 via a serial interface or USB interface or the Ethernet (registered trademark) interface so that the controller 10 can store it in the PLC output conditional expression storer 17.

Returning to FIG. 7, the controller 10 checks whether the user conducts an operation to end the control programs update procedure (the end request operation) via the operator 12 (Step S207). If the user conducts the end request operation (Step S207; YES), the controller 10 ends the control programs update procedure and switches the operation mode to the normal operation mode. On the other hand, if the user does not conduct the end request operation (Step S207; NO), the controller 10 repeats the procedure of the Step S201 and subsequent steps.

As described above, the equipment control device 1 of this embodiment is connected to multiple equipment such as the air conditioners 2 placed in a given area within a building in a communicable manner and installed in or near the area. The equipment control device 1 utilizes programs written in a PLC programming language as the control programs for controlling the air conditioners 2 and further provides to the user an interface OF for updating the control programs.

Therefore, the user can easily update the control programs while knowing the condition of the area. Consequently, the air-conditioning control in accordance with the actual condition of the area can quickly and precisely be realized, leading to improvement in amenity and energy saving.

Furthermore, the equipment control device 1 communicates with the air conditioners 2 placed in the area through a network (network N) different from a network used by the system monitoring device. Therefore, the equipment control device 1 can easily be installed even after the equipment management system consisting of the system monitoring device and other equipment is established.

(Embodiment 2)

Figure 14:
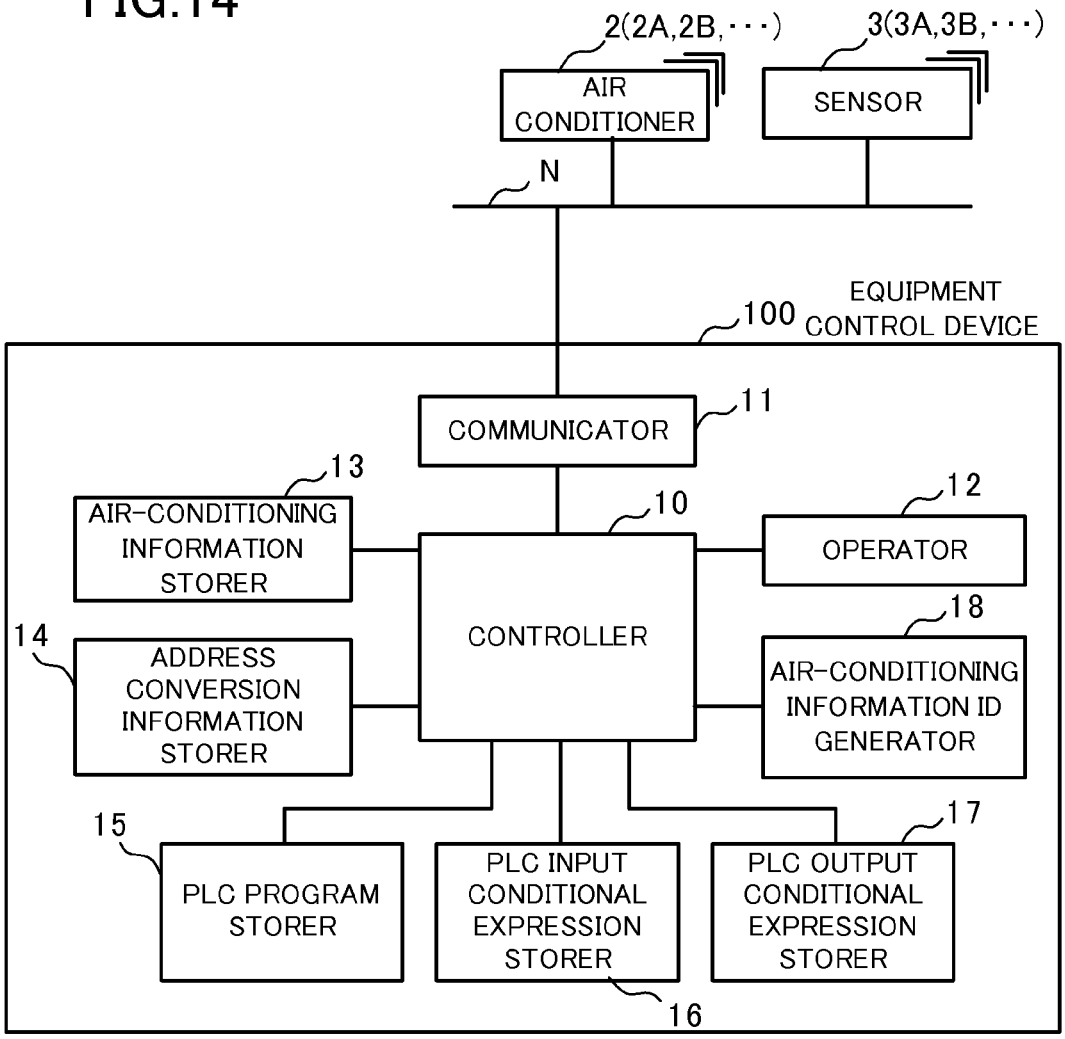
[FIG. 14] A block diagram showing the configuration of an equipment control device according to Embodiment 2 of the present invention.

FIG. 14 is a block diagram showing the configuration of an equipment control device 100 according to Embodiment 2 of the present disclosure. As shown in FIG. 14, the equipment control device 100 has an air-conditioning information ID generator 18 in addition to the configuration of the equipment control device 1 of Embodiment 1 (see FIG. 1). The air-conditioning information ID generator 18 is composed of a CPU (central processing unit) or the like.

The equipment control device 100 having the above configuration has three operation modes including an address conversion information update mode in addition to the normal operation mode and control programs update mode. In the address conversion information update mode, the equipment control device 100 executes an address conversion information update procedure. Here, the function of the address conversion information updater of the present disclosure is realized by the controller 10 and air-conditioning information ID generator 18.

Figure 15:
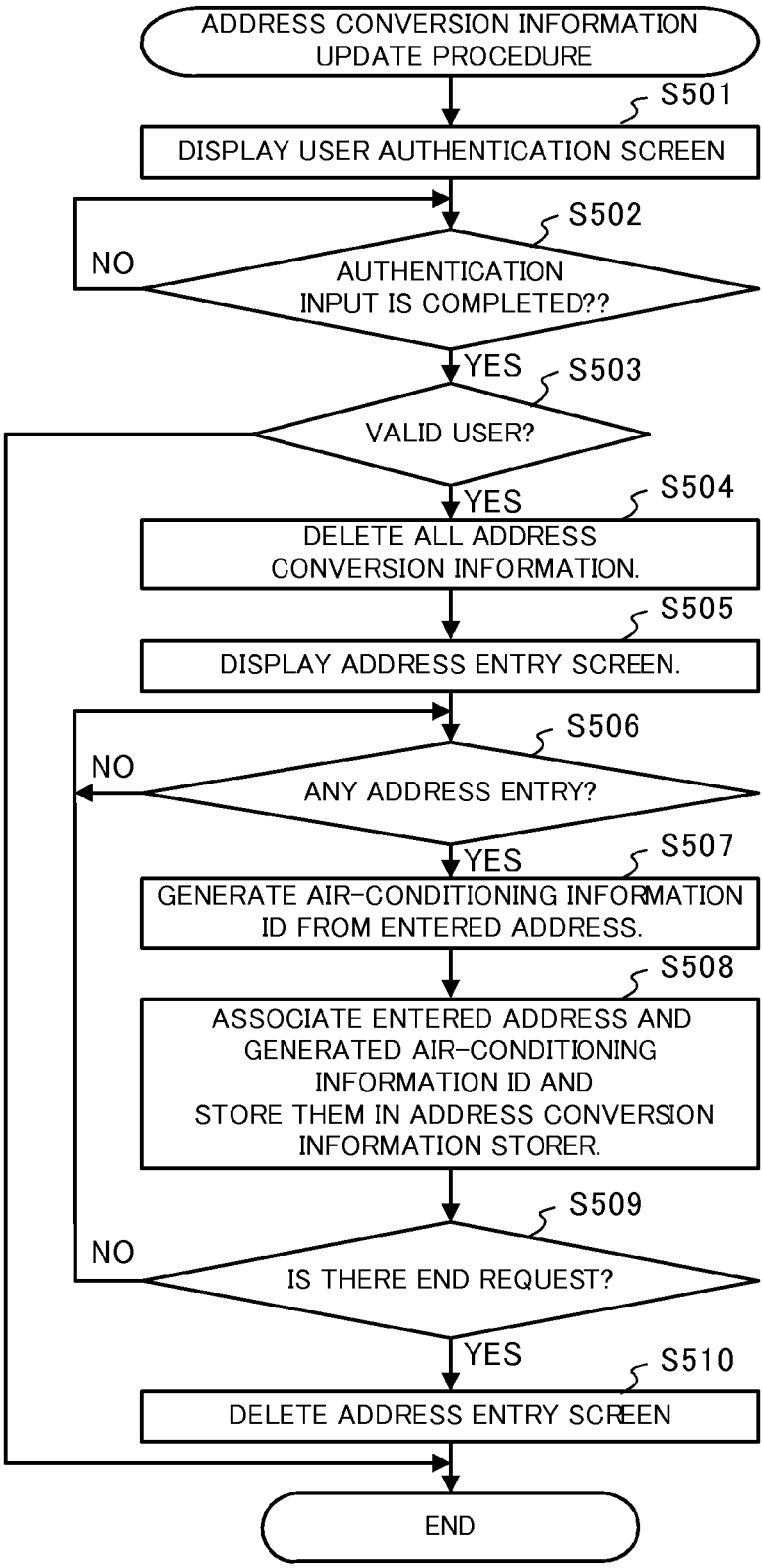
[FIG. 15] A flowchart showing the address conversion information update procedure.

FIG. 15 is a flowchart showing the address conversion information update procedure. The address conversion information update procedure starts when the user (for example, the system administrator) conducts a given operation (a switching operation to the address conversion information update mode) via the operator 12, and the following procedure is repeated until the user conducts an operation to end the procedure (the end request operation).

First, the controller 10 displays on the liquid crystal monitor or the like of the operator 12 a screen (an authentication screen) on which the user enters authentication information (user ID, password, etc.) (Step S501). In this address conversion information update procedure, a very important procedure to associate addresses in the air-conditioning information storer 13 with air-conditioning information IDs is conducted. In this embodiment, it is assumed that the operation authority to execute this procedure is given only to a particular user such as the system administrator.

After the user enters authentication information (Step S502; YES), the controller 10 cross-checks the entered information with authentication information stored in advance and determines whether the user is a valid user (Step S503). If the user is not a valid user (Step S503; NO), the controller 10 ends the address conversion information update procedure and switches the operation mode to the normal operation mode.

On the other hand, if the user is a valid user (Step S503; YES), the controller 10 deletes all address conversion information stored in the address conversion information storer 14 (Step S504). Furthermore, the controller 10 displays on the liquid crystal monitor or the like of the operator 12 a screen (an address entry screen) on which the user enters an intended address (Step S505).

After the user enters an address in the air-conditioning information storer 13 on the address entry screen (Step S506; YES), the controller 10 supplies the entered address to the air-conditioning information ID generator 18. The air-conditioning information ID generator 18 generates an air-conditioning information ID from the address (Step S507). For example, the air-conditioning information ID generator 18 obtains an air-conditioning information ID from the address using a one-way function such as a hash function.

The controller 10 stores the address entered by the user and information generated by the air-conditioning information ID generator 18 to associate with the air-conditioning information ID as address conversion information in the address conversion information storer 14 (Step S508).

The above procedure (Steps S506 to S508) is repeated unless the user conducts an operation to end the address conversion information update procedure (the end request operation) (Step S509; NO).

On the other hand, if the user conducts the end request operation (Step S509; YES), the controller 10 deletes the address entry screen (Step S510), ends the address conversion information update procedure, and switches the operation mode to the normal operation mode.

As described above, the equipment control device 100 of this embodiment provides the user with an environment to update the address conversion information. Consequently, the user such as the system administrator can quickly reset the association between air-conditioning information IDs and addresses in the air-conditioning information storer 13. In this way, when some change is made to the equipment to be controlled such as addition or replacement of equipment, or wrong address conversion information is found, quick action can be taken.

Here, the controller 10 does not need to delete all address conversion information after the user authentication. For example, in the case of defining a new address (namely adding new address conversion information), there will be no change in the existing address conversion information. In such a case, the controller 10 does not need to delete all address conversion information stored in the address conversion information storer 14. Furthermore, in order for the user to edit individual pieces of address conversion information, the controller 10 may display on the liquid crystal monitor or the like of the operator 12 a list of address conversion information read from the address conversion information storer 14 in an editable manner after the user authentication. It is more efficient to allow for partial update where a small amount of change is made.

In the case of the address conversion information including a filed indicating the content of air-conditioning information (a field "content") (see FIG. 12), the controller 10 provides a field to enter the content of air-conditioning information on the address entry screen and sets the information entered in the field in the field "content."

The present disclosure is not confined to the above embodiments. Needless to say, various modifications can be made without departing from the scope of the present disclosure.

For example, equipment to be controlled by the equipment control device according to the present disclosure is not confined to air conditioners and can be ventilators, lighting equipment, and actuators for opening/closing automatically controllable blinds and ducts.

The type of sensors connected to the equipment control device according to the present disclosure and supplying detection results is not restricted. Besides temperature sensors and humidity sensors, the sensors can be illumination sensors, infrared sensors, or carbon dioxide sensors.

The PLC programming language is not restricted. For example, the ladder logic (LD language), sequential function chart (SFC language), function block diagram (FBD language), structured text (ST language), and instruction list (IL language), which are defined in IEC61131-3, a standard of International Electrotechnical Commission (IEC), can be used.

The present application claims the priority based on the Japanese Patent Application No. 2009-204059, filed on Sep. 3, 2009, of which the entire content is incorporated herein by reference.

Industrial Applicability

The present invention is suitably used as a device controlling equipment such as air conditioners.

Description of Symbols

1, 100 equipment control device
2 air conditioner
3 sensor
10 controller
11 communicator
12 operator
13 air-conditioning information storer
14 address conversion information storer
15 PLC program storer
16 PLC input conditional expression storer
17 PLC output conditional expression storer
18 air-conditioning information ID generator

The invention claimed is:

1. An equipment control device, comprising:

a communicator for transmitting and receiving data with one or multiple equipments placed in a given area via a given network;

an equipment information storer storing data received by the communicator from said equipment as equipment information;

a PLC program storer storing a PLC (Programmable Logic Controller) program;

a control details determiner executing control programs including at least said PLC program, determining control details of said each equipment based on said equipment information stored in said equipment information storer, and storing the determined control details as said equipment information in said equipment information storer;

a control necessity determiner determining whether it is necessary to conduct control over a corresponding equipment based on the control details determined by the control details determiner;

a control data transmitter transmitting control data based on the control details to the corresponding equipment via said communicator when said control necessity determiner determines that it is necessary to conduct the control;

an operator receiving operations from a user and displaying processing results based on the operation; and a PLC program updater updating said PLC program based on operations from the user, wherein said equipment information storer stores said equipment information at an address predetermined based on the corresponding equipment and the content thereof.

2. The equipment control device according to claim 1, wherein:

said PLC program updater displays the source codes of the current PLC program in an editable manner by said operator when the user conducts an operation to request update of said PLC program.

3. The equipment control device according to claim 1, wherein:

said communicator further receives detected data from one or multiple sensors placed in said given area via said given network; and said equipment information storer stores the detected data received by said communicator from said sensors as said equipment information.

4. The equipment control device according to claim 1, wherein:

said operator receives input of control details of said equipment from the user; and said equipment information storer stores said control details received by said operator as said equipment information.

5. The equipment control device according to claim 1, further comprising:

a PLC input conditional expression storer storing PLC input conditional expression stating that when the content indicated by said each equipment information stored at one or multiple specified addresses in said equipment information storer satisfies a specified condition, a specified value is stored in a specified output destination; and a PLC output conditional expression storer storing PLC output conditional expression stating that when the execution results of said PLC program satisfies a specified condition, a specified value is stored at a specified address in said equipment information storer, wherein said control programs further include a PLC input program executing said PLC input conditional expression and a PLC output program executing said PLC output conditional expression, and said control details determiner executes said PLC program after executing said PLC input program, and then executes said PLC output program.

6. The equipment control device according to claim 5, further comprising:

a PLC input conditional expression updater updating said PLC input conditional expression based on operations from the user; and a PLC output conditional expression updater updating said PLC output conditional expression based on operations from the user.

7. The equipment control device according to claim 1, further comprising:

an address conversion information storer storing address conversion information associating the address of said each equipment information stored in said equipment information storer with identification information uniquely identifying the address.

8. The equipment control device according to claim 7, further comprising:

an address conversion information updater updating said address conversion information based on operations from the user.

* * * * *